US008028550B2

(12) United States Patent
Duncan et al.

(10) Patent No.: US 8,028,550 B2
(45) Date of Patent: Oct. 4, 2011

(54) LAUNDRY APPLIANCE

(75) Inventors: Anna Kathryn Duncan, Mt. Eden (NZ); Erin Louise Hall, Whitford (NZ); Geoffrey Walker, Papatoetoe (NZ); Gerald David Duncan, Mt. Eden (NZ); Flavio E. Bernardino, St. Joseph, MI (US); Mary Ellen Zeitler, St. Joseph, MI (US); David Wayne Carr, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/010,457

(22) Filed: Jan. 20, 2011

(65) Prior Publication Data

US 2011/0107799 A1 May 12, 2011

Related U.S. Application Data

(63) Continuation of application No. 11/470,658, filed on Sep. 7, 2006, now abandoned.

(60) Provisional application No. 60/734,728, filed on Nov. 8, 2005.

(51) Int. Cl.
*D06F 17/00* (2006.01)

(52) U.S. Cl. ..... 68/134

(58) Field of Classification Search ..... 68/134
See application file for complete search history.

(56) References Cited

U.S. PATENT DOCUMENTS

| | | | |
|---|---|---|---|
| 1,234,498 | A | 7/1917 | Seymour, Jr. |
| 1,632,866 | A | 6/1927 | Altorfer |
| 1,704,932 | A | 3/1929 | Altorfer |
| 2,111,152 | A | 3/1938 | Nelson |
| 2,274,402 | A | 2/1942 | Dunham |
| 2,302,012 | A | 11/1942 | Dyer |
| 2,432,766 | A | 12/1947 | Kirby |
| 2,470,140 | A | 5/1949 | Castner |
| 2,561,257 | A | 7/1951 | Woodson |
| 2,584,833 | A | 2/1952 | Beucler |
| 2,621,505 | A | 12/1952 | Smith |
| 2,630,001 | A | 3/1953 | Criner |
| 2,656,431 | A | 10/1953 | Bochan |
| 2,665,576 | A | 1/1954 | Thiele |
| 2,695,510 | A | 11/1954 | Clark |
| 2,742,772 | A | 4/1956 | Romine |

(Continued)

FOREIGN PATENT DOCUMENTS

EP 0450833 B1 10/1991

(Continued)

OTHER PUBLICATIONS

Hitachi Washer Sales Literature, 13 pages, dated Nov. 1992.*

(Continued)

*Primary Examiner* — Michael Barr
*Assistant Examiner* — Jason P Riggleman

(57) ABSTRACT

A laundry machine configured to supply a first amount of water to the wash tub wherein a wash plate can be oscillated such that clothes items directly above and in contact with the impeller are frictionally dragged in a oscillatory manner with the wash chamber while continuing to oscillate said wash plate, an additional supply of water is added to said wash tub such that as cloth items lost frictional engagement with the wash plate, the cloth items continue to move along an inverse toroidal rollover path at higher water levels.

14 Claims, 6 Drawing Sheets

U.S. PATENT DOCUMENTS

| | | | |
|---|---|---|---|
| 2,883,843 | A | 4/1959 | Bochan |
| 2,911,811 | A | 11/1959 | Clark |
| 2,986,910 | A | 6/1961 | Bochan |
| 3,066,521 | A | 12/1962 | Gillessen |
| 3,184,933 | A | 5/1965 | Gaugler |
| 3,197,979 | A | 8/1965 | Phillips et al. |
| 3,197,980 | A | 8/1965 | Marple |
| 3,216,226 | A | 11/1965 | Alger et al. |
| 3,302,433 | A | 2/1967 | Nallinger |
| 3,387,310 | A | 6/1968 | Marshall |
| 3,388,410 | A | 6/1968 | Marshall |
| 3,478,373 | A | 11/1969 | McBride et al. |
| 3,498,090 | A | 3/1970 | Mason |
| 3,557,579 | A | 1/1971 | Marshall |
| 3,589,151 | A | 6/1971 | Gorsuch |
| 3,647,354 | A | 3/1972 | Loeb |
| 3,650,673 | A | 3/1972 | Ehner |
| 3,740,975 | A | 6/1973 | Cornelius |
| 3,811,300 | A | 5/1974 | Barton et al. |
| 3,987,652 | A | 10/1976 | Ruble |
| 4,048,820 | A | 9/1977 | Pielemeier |
| 4,068,503 | A | 1/1978 | Platt |
| 4,087,368 | A | 5/1978 | Borrello |
| 4,137,736 | A | 2/1979 | Platt et al. |
| 4,137,737 | A | 2/1979 | Robandt, II et al. |
| 4,207,760 | A | 6/1980 | Bochan |
| 4,225,992 | A | 10/1980 | Morey |
| 4,328,600 | A | 5/1982 | Bochan |
| 4,489,455 | A | 12/1984 | Spendel |
| 4,489,574 | A | 12/1984 | Spendel |
| 4,494,390 | A | 1/1985 | Hayashi et al. |
| 4,503,575 | A | 3/1985 | Knoop et al. |
| 4,554,805 | A | 11/1985 | Hirooka et al. |
| 4,693,095 | A | 9/1987 | Burk et al. |
| 4,779,431 | A | 10/1988 | Burk et al. |
| 4,784,666 | A | 11/1988 | Brenner et al. |
| 4,858,450 | A | 8/1989 | Noh |
| 5,253,380 | A | 10/1993 | Lim et al. |
| 5,353,613 | A | 10/1994 | Smith et al. |
| 5,398,298 | A | 3/1995 | Ensor |
| 5,487,284 | A | 1/1996 | Kim et al. |
| 5,557,952 | A | 9/1996 | Sundell et al. |
| 5,595,072 | A | 1/1997 | Bai et al. |
| 5,619,870 | A | 4/1997 | Kim et al. |
| 5,638,704 | A | 6/1997 | Kim et al. |
| 5,651,278 | A | 7/1997 | Pinkowski |
| 5,689,847 | A | 11/1997 | Tremel et al. |
| 5,839,300 | A | 11/1998 | Yoon et al. |
| 5,878,602 | A | 3/1999 | Kovich et al. |
| 6,212,722 | B1 | 4/2001 | Pinkowski et al. |
| 7,628,044 | B2 | 12/2009 | Kopyrin et al. |
| 2003/0200774 | A1 | 10/2003 | Kim et al. |

FOREIGN PATENT DOCUMENTS

| | | | | | |
|---|---|---|---|---|---|
| EP | 0837171 | A1 | | 4/1998 | |
| JP | 4972960 | | | 7/1974 | |
| JP | 50130255 | | | 10/1975 | |
| JP | 52097269 | A | | 8/1977 | |
| JP | 54120956 | A | | 9/1979 | |
| JP | 354120956 | A | * | 9/1979 | ..... 68/23 R |
| JP | 56040196 | | | 4/1981 | |
| JP | 58049184 | | | 3/1983 | |
| JP | 58109094 | | | 6/1983 | |
| JP | 58141179 | | | 8/1983 | |
| JP | 58141180 | | | 8/1983 | |
| JP | 59017395 | A | | 1/1984 | |
| JP | 59017398 | | | 1/1984 | |
| JP | 1146584 | A | | 6/1989 | |
| JP | 4099589 | A | | 3/1992 | |
| JP | 5038968 | A | | 2/1993 | |
| JP | 5098164 | A | | 4/1993 | |
| JP | 6000276 | A | | 1/1994 | |
| JP | 6114189 | A | | 4/1994 | |
| JP | 9056971 | A | | 3/1997 | |
| JP | 9056972 | A | | 3/1997 | |
| JP | 9094371 | A | | 4/1997 | |
| JP | 9094372 | A | | 4/1997 | |
| JP | 9239189 | A | | 9/1997 | |
| JP | 10272283 | A | | 10/1998 | |
| KR | 0151283 | B1 | | 12/1998 | |

OTHER PUBLICATIONS

Declaration of Soichi Fukuzawa dated Sep. 28, 2005, at 1-26-8 Nishi Narusawa-machi, Hitachi-shi, Ibaraki-ken, Japan.

*Whirlpool Corporation and Whirlpool Patents Company* v. *GE Electronics, Inc., GE Electronics U.S.A., Inc., and General Electric Company,* Supplemental Rebuttal Expert Report of Gerald Duncan, Case No. 1:04CN0100, dated Oct. 20, 2005.

*Whirlpool Corporation and Whirlpool Patents Company* v. *GE Electronics, Inc., GE Electronics U.S.A., Inc., and General Electric Company,* Responses of Defendant General Electric Company to Whirlpool's Third Set of Interrogatories (Nos. 19-21), Case No. 1:04CV0100, dated Sep. 2, 2005.

*Whirlpool Corporation and Whirlpool Patents Company* v. *LG Electronics, Inc., LG Electronics U.S.A., and General Electric Company, and LG Electronics Inc.* v. *Whirlpool Corporation and Whirlpool Patents Company,* Identification of Prior Art by Defendent General Electric Company, Case No. 1:04-cv-100, dated Jan. 14, 2005.

*Whirlpool Corporation and Whirlpool Patents Company* v. *LG Electronics, Inc. and LG Electronics U.S.A., Inc.,* LG's Second Supplemental Responses to Whirlpool's First Set of Interrogatories to Defendents (Nos. 4,8,9,10), Case No. 1:04CV0100, dated Jul. 15, 2005.

*Whirlpool Corporation and Whirlpool Patents Company* v. *LG Electronics, Inc. and LG Electronics U.S.A., Inc.,* LG's Fourth Supplemental Responses to Whirlpool's Interrogatories (Nos. 14 and 21), Case No. 1:04CV0100, dated Nov. 7, 2005.

*Whirlpool Corporation and Whirlpool Patents Company* v. *LG Electronics, Inc. and LG Electronics U.S.A., Inc.,* LG's Identification of Prior Art, Case No. 1:04 CV 0100, dated Jul. 19, 2004.

*Whirlpool Corporation and Whirlpool Patents Company* v. *LG Electronics, Inc. and LG Electronics U.S.A., Inc., and General Electric Company,* Reply Brief of Defendants-Appellants LG Electronics Inc., LG Electronics U.S.A., Inc., and General Electric Company, Case No. 1:04-CV-0100, dated Apr. 28, 2008.

English translation of the Expert Report of Mr. Tamotsu Shikamori, originally written in Japanese, dated Jul. 22, 2005.

*Whirlpool Corporation and Whirlpool Patents Company* v. *LG Electronics, Inc., LG. Electronics U.S.A., Inc., and General Electric Company, and LG Electronics, Inc.,* v. *Whirlpool Corporation and Whirlpool Patents Company,* Defendants' Motion for Summary Judgment No. 3: Invalidity of '722 Patent in View of Prior Art, Case No. 1:04-cv-0100, dated Jan. 9, 2006.

*Whirlpool Corporation and Whirlpool Patents Company* v. *LG Electronics, Inc. and LG Electronics U.S.A., Inc., and General Electric Company,* Whirlpool's Brief in Opposition to Defendants' Motion for Summary Judgment No. 3: Invalidity of the '722 Patent in View of Prior Art, Case No. 1:04CV0100, dated Feb. 9, 2006.

*Whirlpool Corporation and Whirlpool Patents Company* v. *LG Electronics, Inc., LG Electronics U.S.A., Inc., and General Electric Company, and LG Electronics, Inc.,* v. *Whirlpool Corporation and Whirlpool Patents Company,* Defendant's Reply on its Motion No. 3 for Summary Judgment of Invalidity of the '722 Patent based on Prior Art, Case No. 1:04-cv-100, dated Feb. 27, 2006.

*Whirlpool Corporation and Whirlpool Patents Company* v. *LG Electronics, Inc. and LG Electronics U.S.A., Inc., and General Electric Company,* Supplemental Expert Witness Report of Dr. Robert Sundell, Case No. 1:04CV0100, dated Sep. 20, 2005.

*Whirlpool Corporation and Whirlpool Patents Company* v. *LG Electronics, Inc. and LG Electronics U.S.A., Inc., and General Electric Company,* Defendants' Supplemental Notice of Prior Art under 35 U.S.C. §282, Case No. 1:04CV0100, dated Aug. 10, 2006.

*Whirlpool Corporation and Whirlpool Patents Company* v. *LG Electronics, Inc. and LG Electronics U.S.A., Inc., and General Electric Company,* Brief of Plaintiffs-Cross Appellants Whirlpool Corporation and Whirlpool Patents Company, Case No. 1:04-CV-100, dated Feb. 13, 2008.

*Whirlpool Corporation and Whirlpool Patents Company* v. *LG Electronics, Inc. and LG Electronics U.S.A., Inc., and General Electric Company,* Reply Brief of Plaintiffs-Cross Appellants Whirlpool Corporation and Whirlpool Patents Company, Case No. 1:04-CV-100, dated May 29, 2008.
Daewoo Air-Power Washer Brochure, CNA International, Inc., 455 E. State Parkway, Suite 104, Schaumburg, IL 60173, 5 pages, date prior to Nov. 8, 2005.
Daewoo Autowasher Model No.:DWF-1088 PA Instruction Manual, 25 pages, date prior to Nov. 8, 2005.
Daewoo Bubbling Shock Wave Applied Washer Model:DWF-1088 PA Pictures, 7 pages, date prior to Nov. 8, 2005.
Daewoo Autowasher Model No.:DWF-9290PA Instruction Manual, 31 pages, date prior to Nov. 8, 2005.
Hitachi NW-60R5, 48 pages, date prior to Nov. 8, 2005.
Hitachi Washer Sales Literature, 24 pages, dated Nov. 1992.
Hitachi Washer Sales Literature, 22 pages, dated Mar. 1996.
Hitachi Washer Sales Literature, 25 pages, dated May 1995.
Hitachi Washer Sales Literature, 21 pages, dated Jul. 1993.
National NA-F55Y6T Washing Machine Operating Instructions, Matsushita Electric Industrial Col, Ltd., Central P.O. Box 288, Osaka 530-91, Japan, 32 pages, date prior to Nov. 8, 2005.
Thor Brochure, Thor Corporation, 2115 South 54th Avenue, Chicago 50, Illinois, 23 pages, date prior to Nov. 8, 2005.
LG WF-1900A/1900A1 Manual, 46 pages, date prior to Nov. 8, 2005.

* cited by examiner

LAUNDRY APPLIANCE

This application is a continuation of U.S. application Ser. No. 11/470,658, filed Sep. 7, 2006, which claims the benefit of Provisional application 60/734,728, filed on Nov. 8, 2005, both of which are incorporated by reference in their entirety.

FIELD OF THE INVENTION

The present invention relates to laundry appliances and in particular to laundry washing machines for household use.

BACKGROUND TO THE INVENTION

U.S. Pat. No. 6,212,722 proposes an improved laundry washing machine for domestic use. This machine is of the top loading type having an outer bowl, a wash basket within the outer bowl and access to the wash basket through a top opening. A motor is provided to drive rotation of the wash basket within the outer bowl. A wash plate is provided in the lower portion of the wash basket to be rotated by the motor with the wash basket or independently of the wash basket. The patent proposes a combination of water level control, wash plate design, wash basket design and movement pattern for the wash plate which leads to an inverse toroidal movement of the laundry load during a wash phase. The sodden wash load is dragged by friction radially inward on the upper surface of the wash plate and progresses upward in the region of the centre. The sodden wash load then progresses radially outward to the wall of the wash basket and downward to the base of the wash basket. This has been found to provide an effective wash action with low water consumption.

The patent indicates that this is only achieved at water levels within a determinable band. With too much water the inverse toroidal rollover motion is not achieved because the clothes lose frictional contact with the wash plate.

The present inventors have ascertained a desire to include an effective wash mode that sacrifices a degree of water efficiency in favour of dilution of the wash solution. The inventors consider this to be particularly desirable in the case of heavily soiled laundry items or laundry items having insoluble soiling, such as muddy, sandy or grass covered sports clothes, and in the case of laundry subject to dye leakage.

The inventors consider that the laundry machine described in U.S. Pat. No. 6,212,722 is only partially effective in this regard. At higher water levels in which the machine cannot perform the inverse toroidal rollover pattern the inventors consider the machine is likely to provide a less effective wash action. The effect of inverse toroidal wash action by dragging is only available at low water levels, and there is a middle water level at which no rollover occurs. Where the laundry load does not rollover wash action of clothing against the wash plate is limited to a small fraction of the load and wash performance suffers.

SUMMARY OF THE INVENTION

It is an object of the present invention to provide a laundry machine which goes some way toward overcoming the above disadvantages or which will at least provide the public with a useful choice.

In a first aspect, the invention may broadly be said to consist in a laundry machine comprising a cabinet, a wash tub supported within the cabinet, a motor suspended beneath the wash tub, a wash basket rotatably supported within the wash tub and drivingly connected to the motor, and a wash plate disposed in the bottom of the wash basket and defining an outer periphery. The wash plate comprises a central hub encircled by the outer periphery, a plurality of vanes extending substantially radially from the central hub toward the outer periphery. The vanes comprise a continuously increasing width as they extend radially away from the hub, a pair of sidewalls diverging as they extend away from the hub, an outer portion terminating at the outer periphery, a shoulder extending from the hub and transitioning into the outer portion, wherein the shoulder is located above the outer portion and both the outer portion and shoulder have a convex cross section. Further, the wash plate is rotatably supported in the wash basket and drivingly connected to the motor to oscillate the wash plate such that the cloth items directly above the wash plate are frictionally dragged in an oscillatory manner and the cloth items rollover within the wash basket along an inverse toroidal rollover path.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

DETAILED DESCRIPTION

The present invention relates to improvements and adaptations on the wash system described in U.S. Pat. No. 6,212,722. The contents of that patent are incorporated herein by reference.

Figure 1:
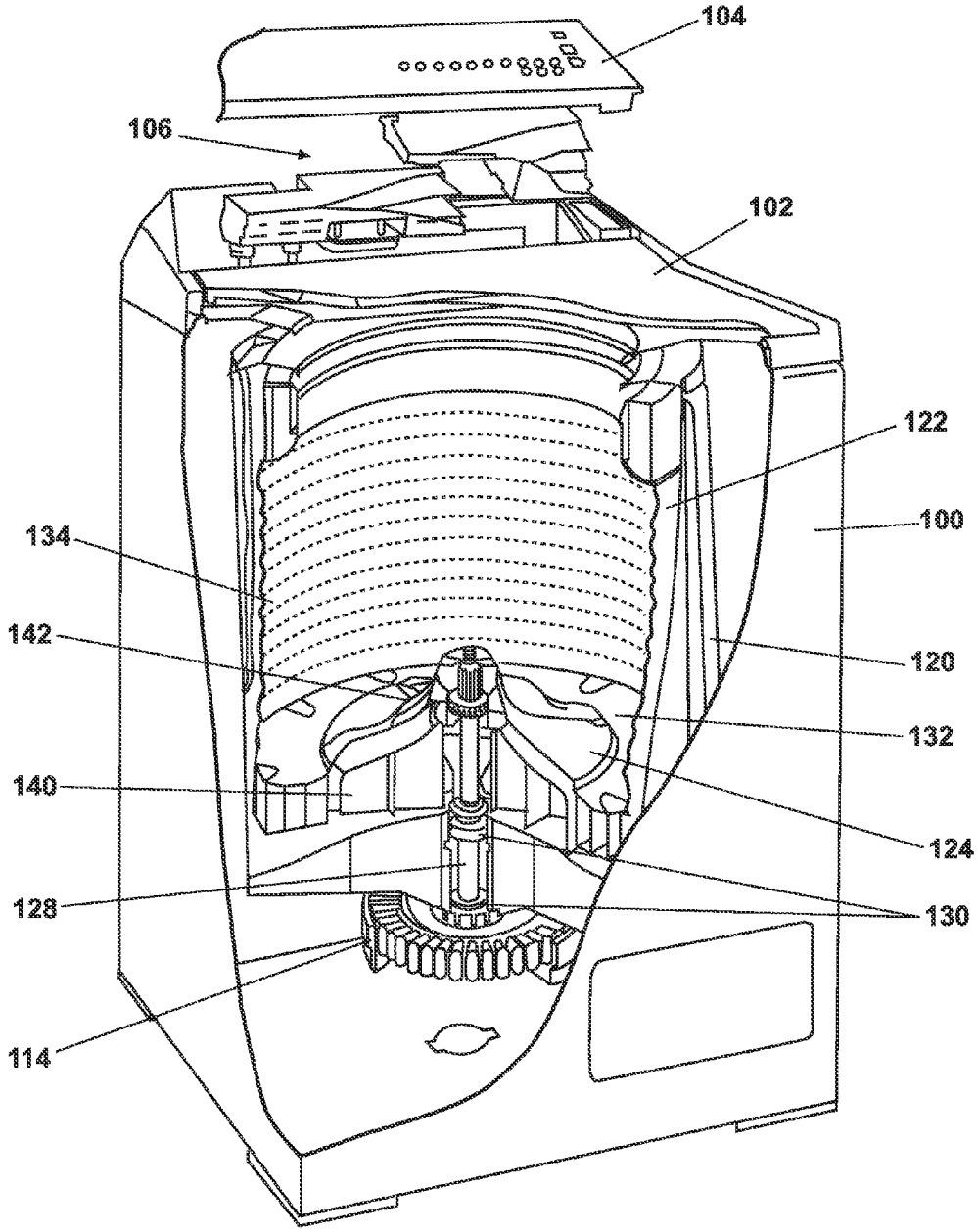
FIG. 1 is a cutaway perspective view of a laundry machine according to a preferred embodiment of the present invention.

A laundry machine incorporating improvements and adaptations of the present application is illustrated in FIG. 1. The laundry machine includes a cabinet 100 with a lid 102 and a user console 104. A controller 106 is located within the body of the user console. The controller 106 includes a power supply and a programmed microcontroller. The power supply receives power from the mains supply and supplies power to the microcontroller, to a power supply bridge for the electric motor and to ancillary devices within the machine such as a pump and valves. Delivery of power to the motor 114 and the ancillary devices is at the control of microcontroller. The microcontroller receives inputs from a user interface on console 104.

A tub 120 is supported within the cabinet. The tub is preferably suspended from the upper edge of the cabinet. The tub may alternatively be supported from below or from the sides of the cabinet. A wash or drain pump is fitted to the lower portion of the tub. The pump is preferably located at a sump portion of the tub.

A wash basket 122 is supported for rotation within the tub. Opening the lid 102 provides user access to an upper open end of the wash basket.

A wash plate 124 is mounted in the lower portion of the wash basket.

The improvements and adaptations of the present invention are preferably implemented in a laundry machine of a direct drive type. However other drive systems involving for example gearbox or belts may alternatively be used.

A motor 114 below the tub directly drives a shaft 128. The shaft 128 extends through the lower face of the tub, where it is supported in a pair of bearings 130. Seals prevent water escaping the tub at the interface between the tub and shaft.

The wash basket 122 is mounted on the shaft within the tub. The wash basket may typically comprise a base 132 and a perforated cylindrical skin 134. The perforated cylindrical skin extends up from the base to define an open ended drum. The wash basket may include a balance ring at the upper edge of the cylindrical skin.

The wash plate 124 is also fitted to the shaft, within the wash basket 122.

An arrangement is provided to enable the motor 114 to selectively drive either the wash plate 124 independently of the wash basket 122, or drive the wash basket 122. In driving the wash basket the motor may also drive the wash plate. Various mechanisms have been proposed to accomplish this selective drive. A number of variations including twin concentric shafts and a selectable clutch to connect the motor with either or both shafts are noted in the prior art and may be applied.

Alternatively a floating clutch of a type previously described in U.S. Pat. No. 5,353,613 may be used. The machine illustrated in FIG. 1 makes use of such a floating clutch. The wash basket 122 is slidably mounted on the drive shaft 128. The wash plate 124 is fixed to rotate with the upper end of the drive shaft. The wash basket 122 includes float chambers 140 on the underside of the wash basket base member. The wash basket is allowed to rotate on the shaft. A vertically inter-engaging clutch 142 is provided between the wash basket 122 and wash plate 144 or between the wash basket 122 and shaft 128. A first clutch member having upwardly facing engagements may be provided in conjunction with the wash plate or a spline on the shaft. An downwardly facing clutch member is provided in conjunction with the wash basket. With the wash basket in an upper or raised position the upwardly facing and downwardly facing clutch members are not engaged and the wash basket is free to rotate on the shaft. With the wash basket in a lower position the members are not engaged. In use the wash basket will be disengaged from the shaft when sufficient water has been added to the tub for the wash basket to float to its raised position. The amount of water required before the wash basket floats depends on the weight of laundry in the wash basket. In the floated condition the shaft will drive the wash plate but will not directly drive the wash basket. In the lower condition the shaft will drive the wash plate and wash basket together.

Figure 2:
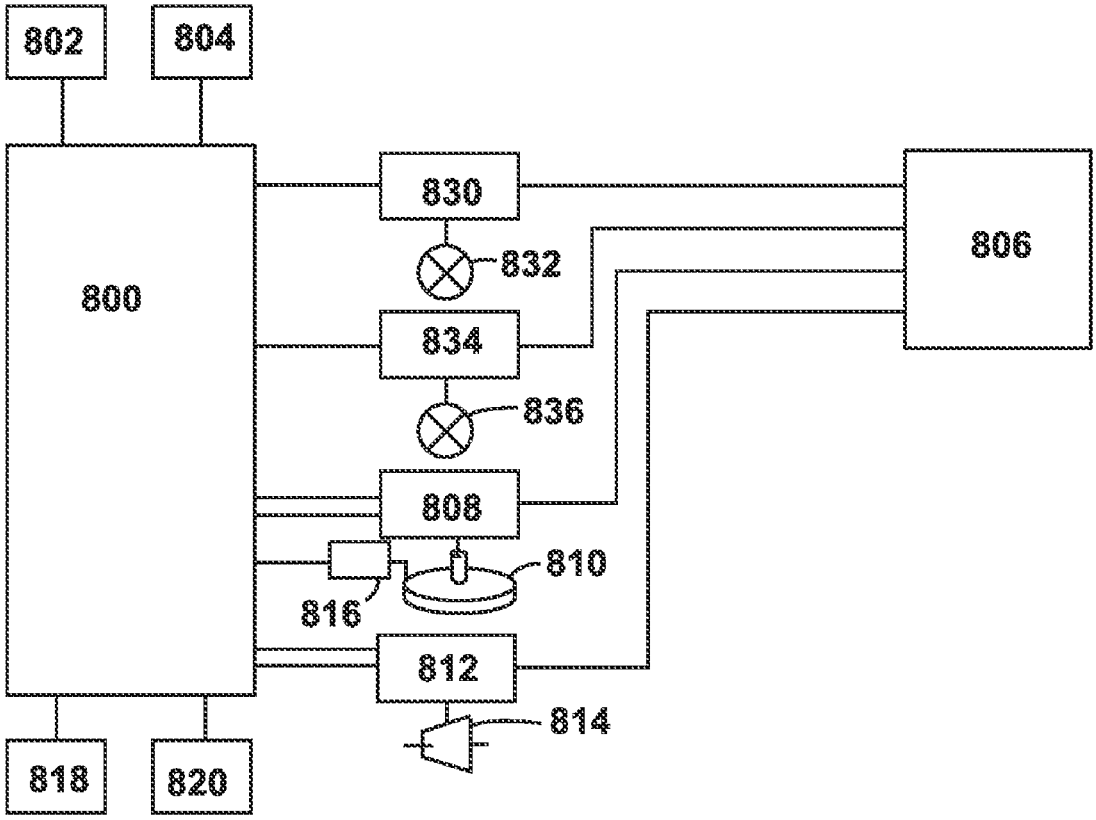
FIG. 2 is a block diagram of a control system for a laundry washing machine.

The controller is part of a control system for coordinating the operations of the laundry machine. The control system is illustrated in the block diagram of FIG. 2. The controller includes a microcontroller 800. The microcontroller may include a micro computer and ancillary logic circuits and interfaces. The micro controller receives user input commands on user interface 802. The user interface may include, for example, a plurality of touch controls such as switches or buttons, or may include a touch screen, or may include rotary or linear selection devices. The micro controller may include a display device 804 to provide feedback to a user. The display device may comprise a plurality of indicators, such as lights or LEDs, or may include a screen display. The display device 804 and the user interface 802 may be mounted to a single module incorporating the micro controller.

The micro controller receives power from a power supply 806. The micro controller also controls power switches 808 applying power from supply 806 to drive motor 810. The micro controller controls further power switches 812 applying power from supply 806 to a pump 814. The micro controller also controls a power switch 830 applying power to a cold water inlet valve 832 and a power switch 834 applying power to hot water inlet valve 836.

The micro controller preferably receives feedback from position sensors 816 associated with the motor. These sensors may for example be a set of digital Hall sensors, sensing changes in rotor position, or may be any suitable encoder. Alternatively rotor position and movement may be sensed from motor drive current or EMF induced in unenergised motor windings.

The micro controller also preferably receives input from a water level sensor 818, which detects the level of water in the tub of the machine, and from a temperature sensor 820 which detects the temperature of water being supplied to the wash tub.

The present application presents several adaptations that enhance the operation of a wash system attempting to induce inverse toroidal rollover by frictional dragging or by fluid mechanics. These adaptations enhance the ability to generate inverse toroidal rollover wash pattern at low water levels and help extend the water levels at which this wash pattern can be maintained. A number of these adaptations involve the shape and configuration of elements of the wash plate. In particular they involve the form of the upper surface of the wash plate, including the presence and location of apertures through the wash plate. Other adaptations involve the shape and size of buffers arrayed on the base of the spin tub around the periphery of the wash plate. An additional aspect involves control methods for helping establish and maintain the inverse toroidal rollover pattern and for beneficially extending the range of operation of the inverse toroidal rollover to higher water levels.

Figure 3:
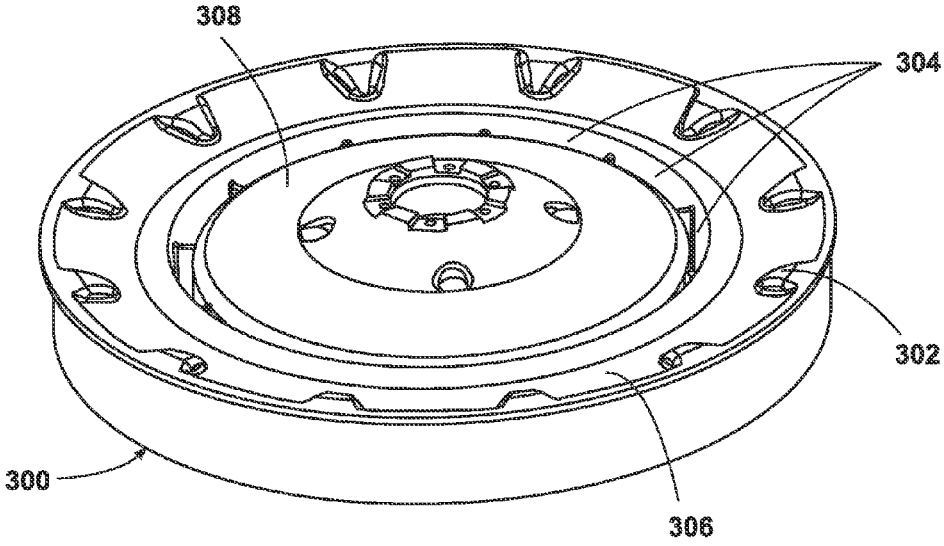
FIG. 3 is a perspective view of the wash basket base moulding according to the machine of FIG. 1.
Figure 4:
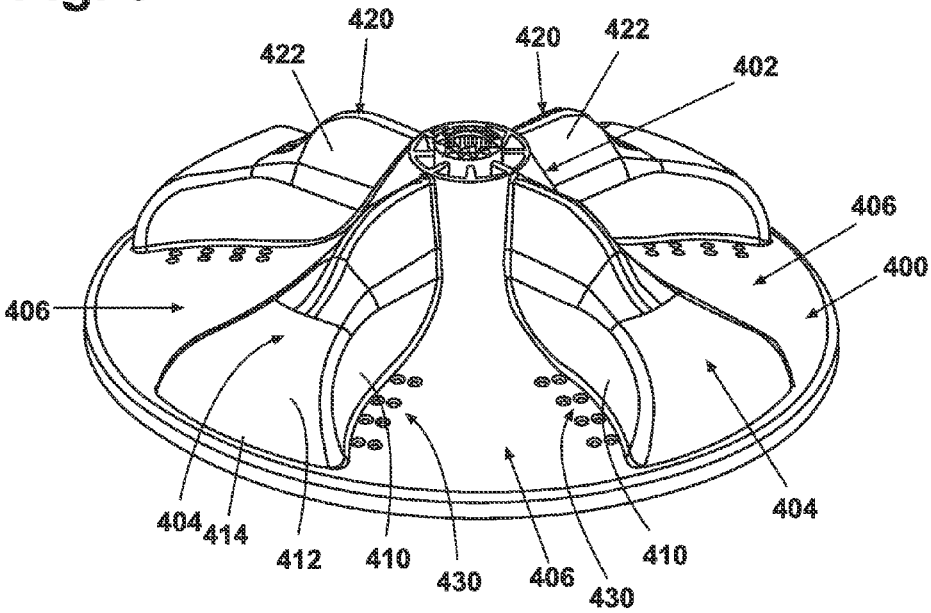
FIG. 4 is a perspective view from above of the wash plate according to a preferred embodiment of the present invention.
Figure 3B:
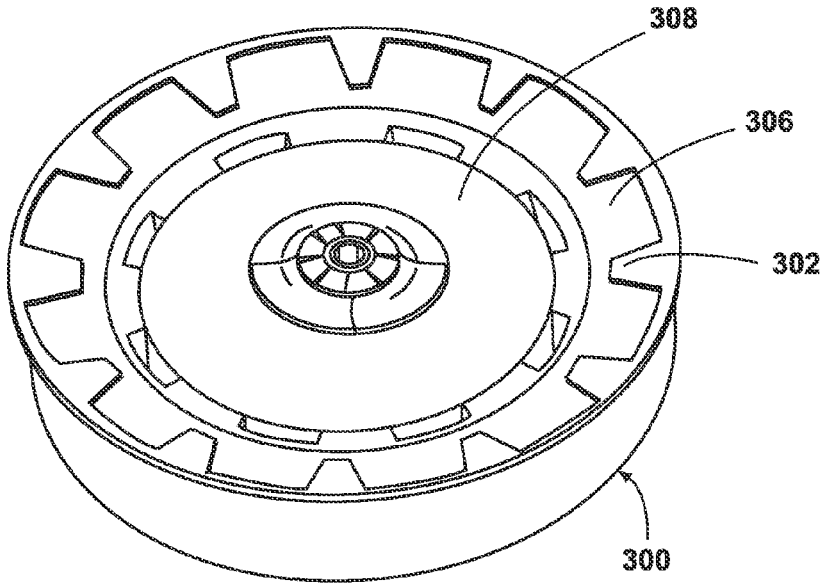
FIG. 3*b* is a perspective view of another embodiment of a wash basket base moulding according to the present invention.
Figure 4B:
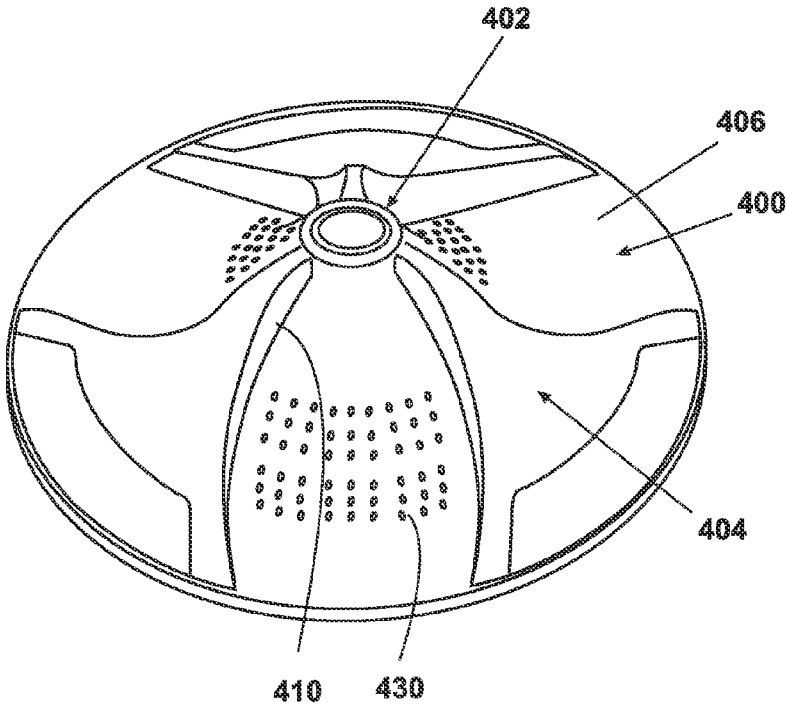
FIG. 4*b* is a perspective view from above of the wash plate according to present invention as shown in 3*b*.
Figure 5:
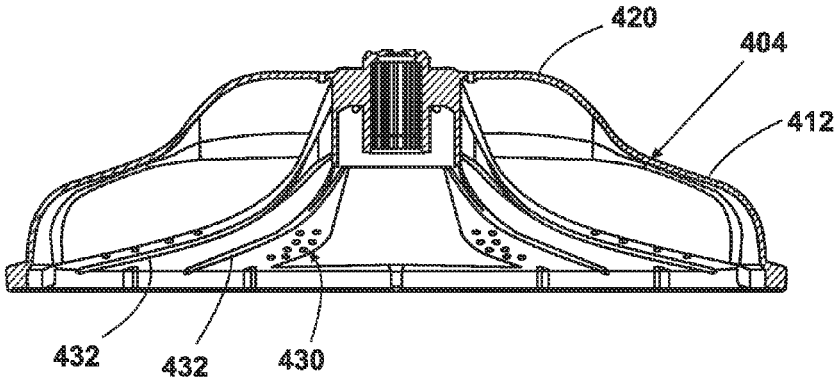
FIG. 5 is a cross-sectional side elevation of the wash plate of FIG. 4.
Figure 6:
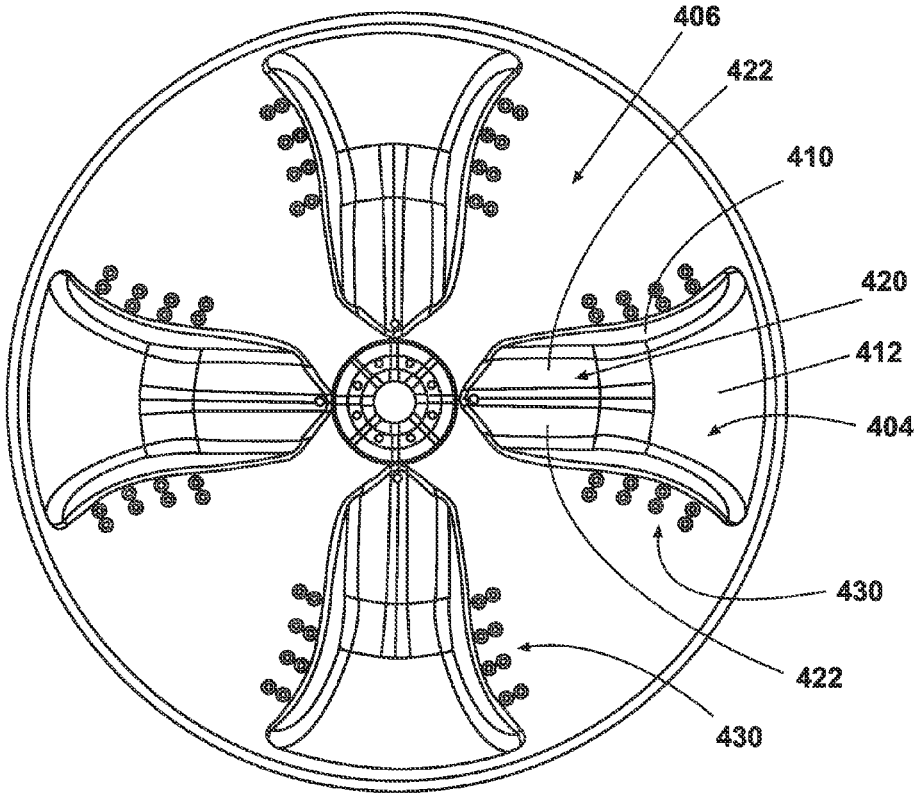
FIG. 6 is a plan view of the wash plate of FIG. 4.

Exemplary wash plates are illustrated in FIGS. 4 to 6. FIGS. 3-5 illustrate one exemplary wash plate and FIGS. 3B and 4B illustrate a second exemplary wash plate. As shown in FIGS. 4 and 4B, the wash plate rises from a generally circular periphery 400 to a raised central hub 402. The upper surface of the wash plate is broadly divided into alternating sectors. The alternating sectors comprise raised sectors 404, or vanes, and intermediate lower sectors 406. The lower sectors 406 are in the general form of a shallow cone with increasing gradient toward the hub 402, so as to be outwardly concave in radial cross-section. This can generally be seen in FIG. 5. In the outer region of the wash plate the low sectors 406 have a generally shallow gradient. In the region closest to the hub 402 the low sectors 406 of the wash plate have a higher gradient.

Each vane 404 has a form devised to enhance initiation and maintenance of inverse toroidal rollover by encouraging the inward dragging of laundry items by friction that are in contact with the upper surface of the wash plate. This enhanced form includes three major features. It is believed that each of these features independently offers an improvement over prior forms. The cumulative improvement offered by these features enables the appliance to maintain inverse toroidal rollover at higher water levels.

Each vane includes a divergent form wherein the width of the vane increases moving from the hub to the periphery of the wash plate. Further, each vane includes steep side walls 410 adjacent the neighbouring low sectors of the wash plate.

The upper face of an outer portion 412 of each vane is generally flat and the vane slopes down towards its outer periphery 414 to the level of the circular periphery 400 of the wash plate.

Each steep side surface 410 of each vane is outwardly concave. That is, the side surfaces of each vane diverge more rapidly as the vane extends toward the outer periphery 400 of the wash plate. Furthermore the opposing side surfaces 410 of adjacent vanes, facing toward one another across the low sector 406 between them, are each concave relative to the other and relative to a radius extending from the centre of the wash plate. The outermost portion of each sidewall hooks toward the adjacent vane so as to be inclined in advance of a radial plane of the wash plate. The inventors have found that such side surfaces 410 aid in dragging the cloth items inward to the centre of the wash plate.

Rapid oscillation of the wash plate provides a centrifugal pumping action inducing radially outward water flow. Such radial flow above the wash plate may inhibit inward movement of the laundry items and is detrimental to establishing the inverse toroidal rollover pattern. The shape of the side surfaces 410 also counteract the centrifugal pumping action of the wash plate as it is oscillated. The inventors have found that the side surfaces 410 aid in achieving inverse toroidal roll-over at all water levels.

In the region of the vane 404 nearer the hub 402 a ridge or shoulder 420 rises from the general outer portion 412 of each vane. The ridge or shoulder 420 has side faces 422 rising to a ridge. The side faces of the shoulder 420 are less steep than the steep side faces 410. When the wash plate is oscillated the angled side faces 422 of the shoulder 420 push on the laundry items near the hub 402 so as to impart a vertical component of force on them. Laundry items near the centre of the wash plate are then thrust upward, which aids inverse toroidal motion.

Preferably there are a plurality of such vanes 404, for example 3, 4, 5 or 6 such vanes. Most preferably there are 3 or 4 such vanes.

Preferably the relative proportion of vane to plan area of the wash plate, is between 0.33 and 0.66.

The shape and size of the washplate, including shoulder area, along with basket capacity, and drive profiles used by the controller, can impact motor temperatures. Accordingly these factors need to be balanced according to the overall machine requirements.

The inventors have found that by providing apertures 430 through the wash plate, radial outward water flow is induced below the wash plate by the shape of the underside of the vanes 404, and that this reduces or compensates for induced outward flow above the wash plate. To enhance outward flow under the wash plate the underside of the wash plate may include a plurality of spaced radial ribs 432.

The base of the wash basket preferably includes an annular series of flow channels extending from the upper side of the base through to the lower side of the base. These channels 304 can be seen in FIG. 3. Fluid may flow from apertures 430 and through these flow channels to the region below the wash basket, between the wash basket and outer tub. This fluid may flow from there out to the wall of the outer tub, upward between the wall of the outer tub and the cylindrical wall of the wash basket and then inward through the perforations of the wash basket. The water flow carries lint into the space between the wash basket and the tub. This lint becomes caught up on the outside of the spin basket and tends not to reenter the spin basket. The lint is then removed in the drain operation subsequent to the wash cycle or is extracted by a lint filter in a recirculation system.

Furthermore, the apertures 430 through the wash plate are preferably provided adjacent each steep side wall 410 of each vane as shown is FIG. 4, or between each steep side wall 410 as shown in FIG. 4B. It is believed that the suction effect generated by the pumping action under the wash plate draws laundry items against the upper surface of the wash plate in these regions directly adjacent the side walls 410 of the vanes. This enhances contact of the laundry items with the side walls 410. It is believed that this contact promotes the inverse toroidal rollover wash pattern. The inventors consider that this effect is useful in promoting maintenance of the inverse toroidal rollover wash pattern with higher water levels, where laundry items otherwise tend to float out of contact with the wash plate.

Figure 7:
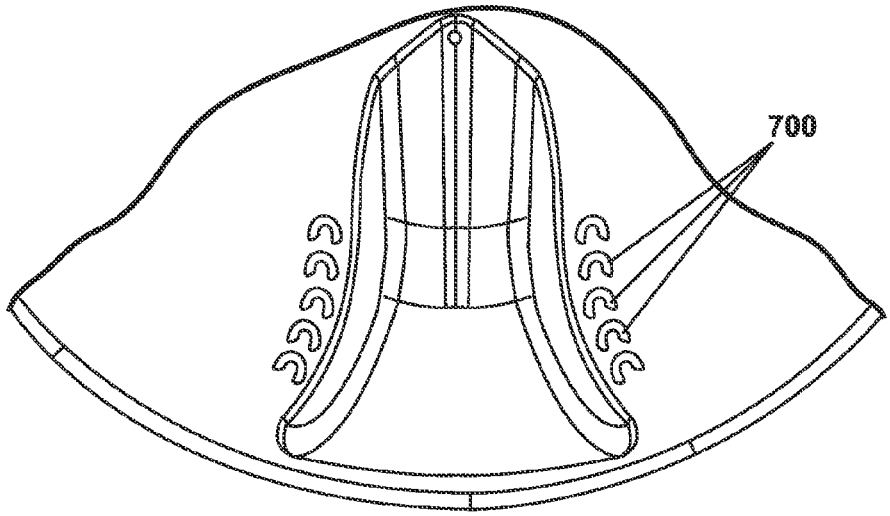
FIG. 7 is a plan view of a section of wash plate including arcuate apertures.

The apertures 430 may comprise small groupings or arrays of circular or shaped holes adjacent the side walls of the vane, or alternatively may comprise one or more elongate slots through the wash plate in the region adjacent the vane. FIG. 7 illustrates an example wash plate including arrays of short curved slots 700, or arcuate holes, in place of circular holes. Sufficient apertures may be provided in the regions of the low sectors adjacent the sidewalls, and may therefore be excluded from regions of the low sectors that are not close to the sidewalls of the vane.

To enhance the dragging effect of the laundry over the surface of the oscillating wash plate the inventors consider it advantageous for the spin basket to resist movement relative to laundry in the lower portion of the spin basket. For this purpose a series of tall buffers was proposed in U.S. Pat. No. 6,212,722. The present inventors now believe that smaller buffers that do not interact with laundry that is well above the level of the wash plate are preferable. A spin basket base member 300 including an annular series of buffers 302 of preferred form is illustrated in FIGS. 3 and 3B. The base member includes a hub portion 308 and a periphery 306. With the wash plate in place the periphery 306 of the base member 300 encloses the space between the outer edge of the wash plate and the cylindrical wall of the wash basket. As seen in FIG. 3 the preferred buffers have a very low profile. Each buffer extends radially inward from the side wall of the spin basket. Each buffer preferably has a height of less than 3 cm, relative to the surrounding surface of the base member. Each buffer has a flattened shape, being several times wider that its height. Each buffer tapers as it extends in toward the wash plate.

The washer is capable of washing in two modes, a high efficiency mode and a traditional deep fill mode. In high efficiency mode the water to clothes ratio is typically less than 10 litres/kg. The traditional deep fill wash typically uses over 15 litres/kg. The two modes each have their benefits. The high efficiency mode uses less water and the more concentrated detergent solution gives excellent soil removal results for soluble soils. The traditional mode uses more water but is better at removing insoluble soils, such as sand and grass.

Wash performance in both modes requires achieving sufficient turnover of the clothes. In the high efficiency mode, higher contact with the wash plate due to lower water level means a marriage between plate shape and plate movement can readily create the inverse toroidal motion.

The preferred controller applies an initial wash plate drive profile to initiate the inverse toroidal motion. The initial drive profile is characterised by higher angular velocity and longer stroke length to start the clothes movement. This movement is subsequently maintained by a maintenance drive profile with lower angular velocity and stroke length. Many drive systems are possible for controlling wash plate drive profiles. One example is described in U.S. Pat. No. 5,398,298.

The initial drive profile is varied according to load size. The profile is more vigorous for larger load sizes. The load size is determined from the amount of water required to float the wash basket. The controller chooses the profile from the bowl float level.

Preferably the maintenance drive profile is also varied according to load size. Again the profile is more vigorous for larger load sizes.

Figure 8:
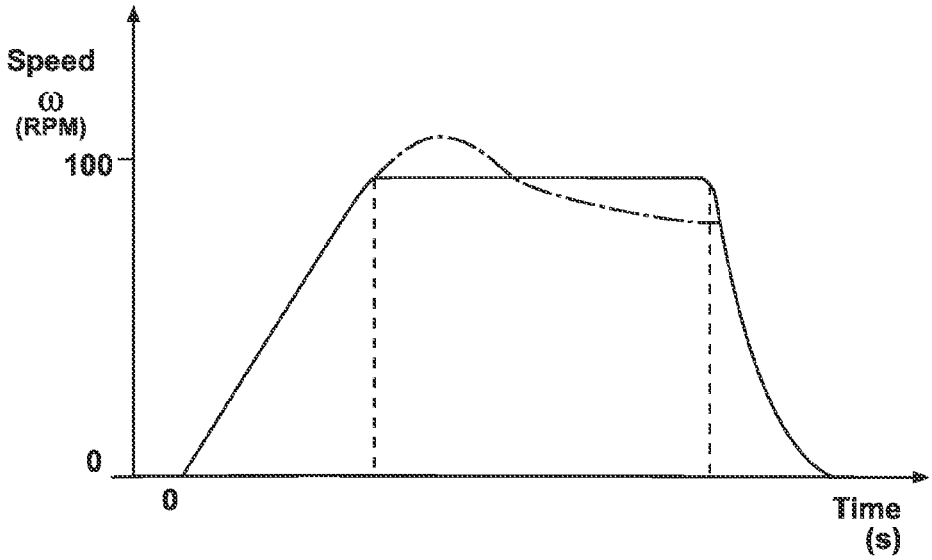
FIG. 8 is a graph of rotational speed versus time, illustrating elements of a wash plate drive profile for exciting toroidal rollover.

By way of example in the preferred embodiment of the present invention the preferred controller can adaptively adjust the drive profile from stroke to stroke to try and maintain a drive profile of certain measured characteristics. An example drive profile is illustrated in FIG. 8. The idealised profile is represented by the solid line. The profile achieved using the control methods described in U.S. Pat. No. 5,398,298 is illustrated by the dot-dash line. The profile includes a ramp where the wash plate speed increases approximately linearly. This ramp is followed by a plateau period. After the plateau period, the wash plate and motor coast to a stop. The stroke is then repeated in the reverse direction. The measured characteristics are plateau speed (ω), ramp time and plateau time. A more vigorous profile is characterised by greater energy input. In the measured characteristics this may be indicated by higher target plateau speed and reduced target ramp time while maintaining an overall stroke duration or angular stroke length.

For example in a test machine the inventors have found the following values for the measured characteristics to provide acceptable results:

SMALL LOADS

| | Initial Profile | | | Maintenance Profile | | |
|---|---|---|---|---|---|---|
| Load Size | Speed | Ramp Time | Plateau Time | Speed | Ramp Time | Plateau Time |
| 1 kg | 85 | 332 | 500 | 77 | 321 | 400 |
| 2 kg | 89 | 299 | 500 | 80 | 299 | 400 |
| 3 kg | 95 | 255 | 500 | 86 | 270 | 400 |

MEDIUM LOADS

| | Initial Profile | | | Maintenance Profile | | |
|---|---|---|---|---|---|---|
| Load Size | Speed | Ramp Time | Plateau Time | Speed | Ramp Time | Plateau Time |
| 3 kg | 91 | 270 | 375 | 87 | 294 | 275 |
| 3.7 kg | 96 | 255 | 400 | 91 | 284 | 300 |
| 5.0 kg | 105 | 248 | 412 | 99 | 277 | 325 |

LARGE LOADS

| | Initial Profile | | | Maintenance Profile | | |
|---|---|---|---|---|---|---|
| Load Size | Speed | Ramp Time | Plateau Time | Speed | Ramp Time | Plateau Time |
| 5.5 kg | 120 | 228 | 462 | 108 | 262 | 362 |
| 6.5 kg | 128 | 216 | 488 | 113 | 257 | 375 |
| 7.0 kg | 130 | 208 | 500 | 116 | 252 | 387 |

The preferred controller operates an adaptive control where the rate of increase in an applied motor voltage, a point of cutting off this rate of increase, and a period of subsequent steady voltage, are each varied from stroke to stroke based on feedback of the resulting measured characteristics of previous strokes. These adjustments may be made in accordance with the methods set out in U.S. Pat. No. 5,398,298.

Acceptable wash performance is considered a compromise between achieving regular inverse toroidal turnover of a wash load within the spin basket and wear and tear associated with wash profiles that are too vigorous (and speeds that are too high) or entanglement (angular strokes that are too long).

In the preferred implementation each of the target measured characteristics for the initial profile is set according to the size of the wash load. The target measured characteristics are also set for the maintenance profile according to the load size. The size of the wash load may be measured in a number of ways known to persons skilled in the art. In the implementation preferred by the inventors the size of the wash load is determined from the level of water in the tub, measured by a water level sensor of any known type, at the water level when the spin basket floats and becomes disconnected from the motor drive shaft. This disconnection may be ascertained by monitoring changes in motor performance which indicate that the motor is no longer directly driving rotation of the spin basket.

The inventors have ascertained that these target characteristics of their preferred initial drive profiles and maintenance drive profiles can each be modelled as a curve or series of curves. Accordingly, preferred values for use by the microcontroller may be read from lookup tables or derived from appropriate formulae.

In the traditional deep fill mode there is less contact with the plate. The inverse toroidal laundry movement is started at a low water level preferably the same level as the high efficiency mode using the initial drive profile. However, rather than backing off into the maintenance profile once the inverse toroidal motion is established, for the traditional wash, the controller continues the vigorous profile while continuing to add water.

To initiate inverse toroidal motion the initial drive profile is preferably applied for from one to three minutes. The maintenance profile is generally sufficient to maintain the inverse toroidal motion once the motion has been established. This reduced vigour profile is more suitable for general wash action on the laundry load without excessive wear.

However the inverse toroidal motion may be lost, for example due to unusual load distribution or entanglement of laundry items. Accordingly, in the preferred embodiment of the invention the initial, or a similar vigorous profile, is applied for short periods intermittently in the wash cycle.

The preferred laundry washing machine implementing the present invention includes the capacity to circulate wash liquor from the lower portion of the wash tub to pour or spray the wash liquor onto the laundry load from a location above the laundry load. For example a conduit may lead from the lower portion of the tub to a spray nozzle overhanging the wash basket at the upper edge of the tub. A lower end of the conduit may be supplied with wash liquor from the lower portion of the tub by a pump. The pump may be a separate recirculating pump, or may be the drain pump, with a diverter valve selectively supplying wash liquor to a drain hose, or to the recirculation conduit.

In the case of this preferred laundry device it is preferred that the inverse toroidal rollover wash pattern is established after an initial period of circulating wash liquor without agitation.

This period may include the period prior to there being sufficient wash liquid to establish inverse toroidal rollover. For example, in the most preferred machine including floating disconnection between the spin basket and drive shaft, circulation can occur in the period before disconnection. The period of circulation without agitation may go on beyond this initial float period.

According to a further aspect of the present invention, in a preferred machine with recirculation of wash liquor, the recirculation may be activated during the inverse toroidal rollover wash pattern. The recirculation may be active during establishment of rollover or during maintenance of rollover. In some circumstances the inventors prefer to intermittently activate recirculation during maintenance of toroidal rollover. They consider that this draws water from generally below the wash load and applies this wash liquor to generally above the wash load. This encourages contact between the laundry items and the wash plate. This may be particularly effective in conjunction with the apertures through the wash plate, as this circulation liquid is drawn from wash liquid beneath the spin basket, and this liquid has generally passed through the apertures of the wash plate. The inventors further consider that this may be particularly beneficial in the case of increased water levels, where transfer of wash liquid from below to above the laundry will discourage or counteract floating.

The curving steep side walls and raised shoulders of the wash plate vanes create enough inward and then upward movement to keep the inverse toroidal motion going even when there is reduced contact between the clothes and the wash plate.

In summary, wash plate and drive profile design have created a wash system that means both high efficiency and traditional washing modes are possible in the one machine.

We claim:

1. A laundry machine comprising:
a cabinet;
a wash tub supported within the cabinet;
a motor suspended beneath the wash tub;
a wash basket rotatably supported within the wash tub and drivingly connected to the motor;
a wash plate disposed in a bottom of the wash basket and defining an outer periphery and comprising:
a central hub encircled by the outer periphery;
a plurality of vanes extending substantially radially from the central hub toward the outer periphery, the vanes comprising a pair of side walls diverging as they extend away from the hub, the vanes having a continuously increasing width as they extend radially away from the hub; and
apertures through the wash plate and immediately adjacent the vanes; and
wherein the wash plate is rotatably supported in the wash basket and drivingly connected to the motor to oscillate the wash plate such that cloth items directly above the wash plate are frictionally dragged in an oscillatory manner and the cloth items rollover within the wash basket along an inverse toroidal rollover path, the cloth items are drawn against the vanes by a suction induced through the apertures.

2. A laundry machine comprising:
a cabinet;
a wash tub supported within the cabinet;
a motor suspended beneath the wash tub;
a wash basket rotatably supported within a wash tub and drivingly connected to the motor;
a wash plate disposed in a bottom of the wash basket and defining an outer periphery and comprising:
a central hub encircled by the outer periphery;
a plurality of vanes extending substantially radially from the central hub toward the outer periphery, and comprising:
a continuously increasing width as they extend radially away from the hub;
a pair of side walls diverging as they extend away from the hub;
an outer portion terminating at the outer periphery;
a shoulder extending from the hub and transitioning into the outer portion;
wherein the shoulder is located above the outer portion and both the outer portion and shoulder have a convex cross section; and
wherein the wash plate is rotatably supported in the wash basket and drivingly connected to the motor to oscillate the wash plate such that cloth items directly above the wash plate are frictionally dragged in an oscillatory manner and the cloth items rollover within the wash basket along an inverse toroidal rollover path.

3. A laundry machine according to claim 2 wherein one of the plurality of vanes further comprises side walls that curve apart such that a rate of divergence of the side walls of each vane increases as they extend away from the hub.

4. A laundry machine according to claim 3 wherein the side walls curve so as to be inclined in advance of a radius of the wash plate at the outer periphery.

5. A laundry machine according to claim 2 wherein the vanes occupy between 0.33 and 0.66 of a plan area of the wash plate.

6. A laundry machine according to claim 2 wherein adjacent the outer periphery of each vane a height of the side walls decreases such that the outer portion converges to the outer periphery of the wash plate.

7. A laundry machine according to claim 6 wherein the outer portion of the vane is substantially flat in a circumferential direction extending between the side walls.

8. A laundry machine according to claim 2 wherein the shoulder has converging walls that are less steeply inclined than the side walls.

9. A laundry machine according to claim 2 wherein the shoulder and the hub extend to a height that is 50% to 150% greater than the height of the substantially flat outer portion of one of the plurality of vanes.

10. A laundry machine according to claim 2 wherein the wash plate includes between 3 and 5 vanes.

11. A laundry machine according to claim 2 wherein the wash plate includes apertures through the wash plate between the vanes, the apertures arranged to be immediately adjacent the vanes, and when the wash plate is oscillated such that the cloth items directly above the wash plate are dragged in an oscillatory manner and the cloth items rollover within the wash basket along an inverse toroidal rollover path, the cloth items are drawn against the vanes by a suction induced through the apertures.

12. A laundry machine according to claim 11 wherein there are no apertures through the wash plate except adjacent the vanes.

13. A laundry machine according to claim 11 wherein the apertures are arranged in groups, each group adjacent the side wall of one of the plurality of vanes.

14. A laundry machine according to claim 11 wherein each aperture comprises a slot.

* * * * *